United States Patent [19]

Gallusser et al.

[11] Patent Number: 4,461,526

[45] Date of Patent: Jul. 24, 1984

[54] ANTI-DECOUPLING MECHANISM FOR AN ELECTRICAL CONNECTOR

[75] Inventors: David O. Gallusser, Oneonta; David W. MacAvoy; Stephen Punako, both of Bainbridge; David L. Frear, Afton, all of N.Y.

[73] Assignee: The Bendix Corporation, Southfield, Mich.

[21] Appl. No.: 402,526

[22] Filed: Jul. 28, 1982

[51] Int. Cl.[3] ..... H01R 13/629

[52] U.S. Cl. ..... 339/89 M; 339/DIG. 2

[58] Field of Search ..... 339/89 R, 89 M, 90 R, 339/93 R, 93 C, DIG. 2

[56] References Cited

U.S. PATENT DOCUMENTS

| | | | |
|---|---|---|---|
| 3,017,597 | 1/1962 | Nava et al. | 339/89 M |
| 3,029,407 | 4/1962 | Burton et al. | 339/89 M |
| 3,971,614 | 7/1976 | Paoli et al. | 339/89 R |
| 4,106,839 | 8/1978 | Cooper | 339/89 M |
| 4,109,990 | 8/1978 | Waldron et al. | 339/89 M |
| 4,204,740 | 5/1980 | Krolak | 339/90 R |
| 4,268,103 | 5/1981 | Schildkraut et al. | 339/89 M |
| 4,277,125 | 1/1981 | Ball | 339/89 M |

*Primary Examiner*—John McQuade
*Assistant Examiner*—Thomas M. Kline
*Attorney, Agent, or Firm*—R. J. Eifler; C. D. Lacina

[57] ABSTRACT

In order to retard the rotation of a coupling nut (40) mounted to an electrical connector housing (10) an annular ring (50) comprised of a rubber having a durometer of about 70 is located in pressure tight contact between the housing (10) and coupling nut (40).

3 Claims, 1 Drawing Figure

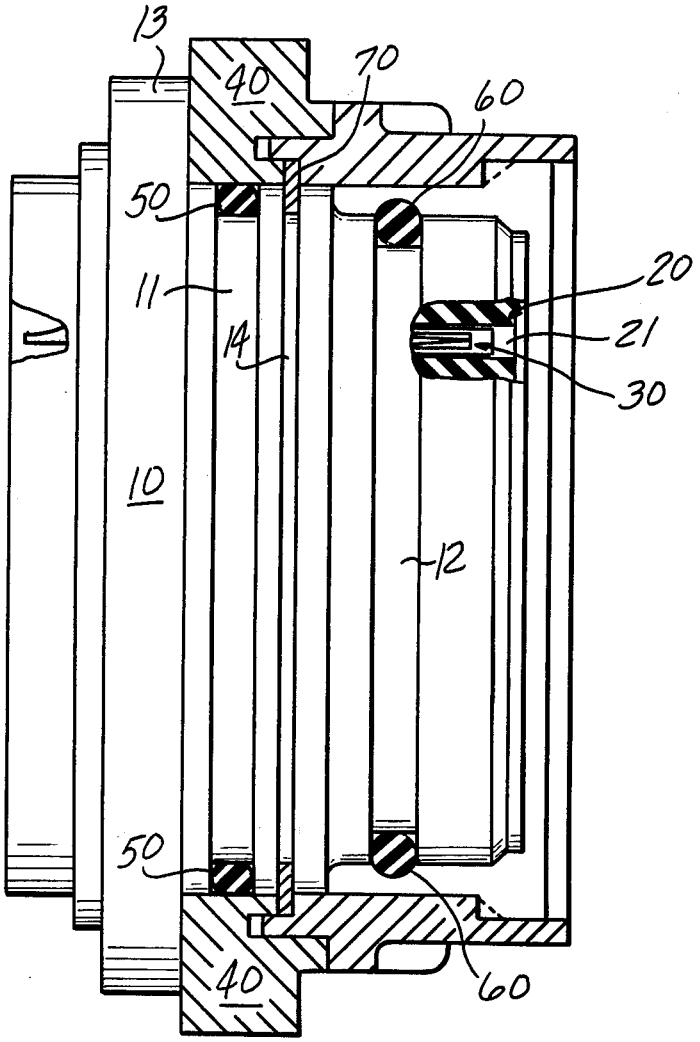
13
40
70
60
50
11
14
20
21
30
10
12
50
40
60

ANTI-DECOUPLING MECHANISM FOR AN ELECTRICAL CONNECTOR

This invention relates to an electrical connector and more particularly to a mechanism that inhibits accidental decoupling of a connector assembly.

An electrical connector assembly is generally comprised of two separate housings such as a plug and receptacle connected together by a coupling member mounted on one of the housings. Some cylindrically shaped connectors have a threaded coupling member mounted on one housing which mates with threads on another housing so that when the housings are placed together and the coupling member is rotated the housings are drawn together mating the contacts within the housings. Such electrical connectors are easily and quickly coupled and decoupled with the use of reasonable forces. However, vibrational forces have a tendency to uncouple these connectors, so some connectors have an anti-decoupling mechanism to avoid this problem. One example of such an anti-decoupling mechanism may be found in U.S. Pat. No. 4,109,990 entitled "Electrical Connector Assembly Having Anti-Decoupling" issued Aug. 29, 1978.

Accordingly, there is a continuing need to provide an anti-decoupling mechanism for an electrical connector that is relatively inexpensive, reliable and easy to assemble into the connector.

DISCLOSURE OF THE INVENTION

This invention is an electrical connector assembly that has an anti-decoupling mechanism that is characterized by an annular ring, comprised of an elastomeric material, located in an annular groove and pressure tight relationship between the coupling nut and housing to which the coupling nut is mounted.

Accordingly, it is an advantage of this invention to provide a relatively inexpensive and simple anti-decoupling mechanism for an electrical connector assembly.

DETAILED DESCRIPTION OF THE INVENTION

The single FIGURE illustrates an electrical connector assembly incorporating the principles of the invention. The electrical connector includes a shell or housing 10 that has mounted therein a dielectric insert 20 having a plurality of bores 21 therein each containing a respective electrical contact 30. A first groove 12 in the connector housing 10 has located therein a rubber O ring 60. It is a function of the O ring 60 to provide a moisture seal between the housing 10, the rotatably mounted coupling nut 40, and another housing (not shown). The coupling nut 40 is rotatably mounted to the housing 10 by captivating a portion of the coupling nut 40 between the radial flange 13 of the housing 10 and a snap ring 70 located in a groove 14 adjacent the flange 13. Immediately below a portion of the coupling ring 40 there is a groove 11 in the housing 10. Located in the groove 11 is an annular ring 50 comprised of a dielectric material which is in pressure tight contact between the coupling nut 40 and the housing 10. The annular ring 50 retards the movement of the coupling nut 40 in either direction and, when the coupling nut is connected to another housing and subjected to vibration, the ring 50 retards rotational movement of the coupling nut 40 thereby preventing unwanted decoupling of the coupling nut 40 from the other housing (not shown). The annular member 50 may be comprised of a plastic or elastomeric material and is preferably comprised of elastomeric material having a durometer of about 70. To further retard rotational movement of the coupling nut either one or both of the surfaces of the annular ring 50 or the inner surface of the coupling ring 40 may be knurled so as to increase the friction between the two surfaces.

While a preferred embodiment of the invention has been disclosed, it will be apparent to those skilled in the art that changes may be made to the invention as set forth in the appended claims and, in some instances, certain features of the invention may be used to advantage without corresponding use of other features. For instance, the connector assembly illustrated shows a coupling nut 40 mounted to the forward portion of the electrical connector but the invention is just as applicable to an electrical connector having the coupling nut 40 mounted behind the radially extending flange 13 of the housing 10. In that instance the groove 14 would be on the rear side of the radially extending flange 13. Accordingly, it is intended that the illustrative and descriptive material herein be used to limited to the principles of the invention and not to limit the scope thereof.

Having described the invention what is claimed is:

1. In combination with an electrical connector assembly of the type having a tubular housing; an insert of dielectric material having a plurality of axial passages therein, said insert mounted within said housing; an electrical contact mounted in each of said passages; a coupling nut, said coupling nut having a rear portion and a forward mating portion; means for rotatably mounting said coupling nut to the outside of said housing, said means for rotatably mounting said coupling nut operatively connected to the rear portion of said coupling nut, said coupling nut adapted to connect to a second housing so that said housing and said second housing may be connected together with their respecitve contacts held in a mated relationship; and means for retarding the rotational movement of the coupling nut, the improvement wherein the means for retarding rotational movement of the coupling nut comprises:

a radial groove in one of said coupling nut and housing located rearwardly of the means for rotatably mounting said coupling nut to said housing; and an annular ring 50, comprised of a dielectric material, located in said annular groove in pressure tight relationship radially between said coupling nut and said housing.

2. The combination recited in claim 1 wherein said annular ring is comprised of plastic.

3. The combination as recited in claim 1 wherein said dielectric material is an elastomeric material having a durometer of about 70.

* * * * *